US006537335B1

(12) United States Patent
Friars et al.

(10) Patent No.: US 6,537,335 B1
(45) **Date of Patent: *Mar. 25, 2003**

(54) COLOR CHANGING CANDLE

(75) Inventors: Gary Friars, Midland Park, NJ (US); Marjorie McManus, Bloomfield, NJ (US)

(73) Assignee: Dragoco Gerberding & Co. AG (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/414,789

(22) Filed: Oct. 8, 1999

(51) Int. Cl.[7] ..... C11C 5/00
(52) U.S. Cl. ..... 44/275; 431/288
(58) Field of Search ..... 44/275; 431/288

(56) References Cited

U.S. PATENT DOCUMENTS

| | | | | |
|---|---|---|---|---|
| 4,717,710 A | | 1/1988 | Shimizu et al. | 503/213 |
| 5,208,132 A | | 5/1993 | Kamada et al. | |
| 5,431,697 A | | 7/1995 | Kamata et al. | 8/483 |
| 5,578,089 A | | 11/1996 | Elsamaloty | |
| 5,798,184 A | | 8/1998 | Sasa et al. | 428/484 |
| 5,843,194 A | * | 12/1998 | Spaulding | 44/275 |
| 5,879,694 A | | 3/1999 | Morrison et al. | |
| 5,882,363 A | * | 3/1999 | Spauling | 44/275 |
| 6,165,234 A | | 12/2000 | Kanakkanatt | |
| 6,200,129 B1 | | 3/2001 | Sullivan et al. | |

FOREIGN PATENT DOCUMENTS

JP 50023405 * 3/1975

OTHER PUBLICATIONS

Patent Abstracts of Japan JP 01 036695–Feb. 7, 1989.
Database WPI XP002159920–CN 1099791 Mar. 8, 1995.
Database WPI XP002159921–JP50023405 Mar. 13, 1975.
Color Tell Printing Inks—Internet page—Oct. 7, 1999.

* cited by examiner

*Primary Examiner*—Cephia D. Toomer
(74) *Attorney, Agent, or Firm*—Pendorf & Cutliff

(57) ABSTRACT

A candle having a selectively and reversibly variable color pattern. In one embodiment, the candle comprises a solid transparent gel with a thermochromic or photochromic pigment dispersed evenly throughout. The candle main body changes from a first color to a second color, or from colored to transparent, or from transparent to colored, in response to heat or light from the candle flame, and reverts to the original color or absence of color upon extinguishing the flame. The candle comprises (a) a solid combustible matrix, and (b) a reversible thermochromic or photochromic composition blended into said solid combustible matrix.

9 Claims, No Drawings

COLOR CHANGING CANDLE

BACKGROUND OF THE INVENTION

1. Field of the Invention

The present invention relates to a candle having a selectively and reversibly variable color pattern. The candle comprises a conventional wax or a solid transparent gel with a thermochromic or photochromic pigment dispersed evenly throughout the main body. The candle main body changes from a first color to a second color in response to heat or light from the candle flame, and reverts to the original color upon extinguishing the flame.

2. Description of the Related Art

Although electric lights have virtually eliminated the need for candles, candles continue to remain popular as a way to provide "atmosphere". Candlelight is associated with romantic dinners, holidays, weddings, anniversaries, etc. However, aside from the addition of fragrances and colors, candles have remained virtually unchanged for hundreds of years, a simple combination of wick and wax.

It is difficult to improve upon the simple elegance of a traditional white candle. While many variations have been proposed over the years, they have not met with commercial success, the modifications often perceived as detracting or intrusive.

For example, U.S. Pat. No. 5,762,487 teaches candles with colored particles that swirl in a pool of molten wax near the flame. While this is interesting, it also detracts from the beauty of the candlelight.

U.S. Pat. No. 4,818,215 teaches a thermally color-changing candleholder. While this is an interesting effect, the candle itself, which is merely a conventional candle inserted into the candleholder, remains unchanged. The effect is not surprising.

U.S. Pat. No. 5,798,184 teaches a candle having a "coloration area" provided on the surface of the candle in the manner of a film by brushing, spraying, or the like. The "coloration area" may contain a pigment that generates fluorescent light upon being irradiated with ultraviolet light, or may contain a luminescent or phosphorescent agent that glows after being illuminated, or may contain organic photochromic compounds that change in color upon receiving light. In the figures, the "coloration area" is shown as intricately shaped flower petals far from the flame, with the main body of the candle being a wide body formed of a conventional wax. It does not appear that this candle can be shaped into a slender candle. It also appears that the coloration areas do not respond to temperature.

The present inventors, keeping in mind the overwhelming popularity of the simple common candle, considered that consumers may not be interested in candles that display complex patterns or images which detract from the simple beauty of a burning candle. The inventors considered that the same consumers may be more willing to accept a candle which changes in display after being lit in a manner which is simple and eloquent, yet subliminally amazing.

SUMMARY OF THE INVENTION

During the course of experimentation, the present inventors developed a new type of candle that has the appearance of a conventional candle, yet changes in display upon being lit in a simple yet intriguing way.

This new type of candle, upon being lit, changes in appearance in a manner which does not detract from the aesthetic beauty of a burning candle, but rather enhances it.

The invention concerns a candle wherein the main body comprises (a) a solid combustible matrix, which may be a conventional wax or a solid clear gel formulation, and (b) a reversible color changing composition, preferably a thermochromic or photochromic composition, the components (a) and (b) preferably forming a homogeneous mixture.

Upon lighting, the light or heat given off by the flame causes the reversible color changing composition contained in the main body to change in color, to loose color, or to become colored, at least in the area nearest the flame. For example, a wax candle with both a blue-to-white thermochromic pigment and a conventional red pigment homogeneously mixed into the main body would appear to have a solid purple body. Upon lighting the candle, the top two inches of the candle would turn red (the red pigment in the candle main body remaining unaffected while the thermochromic pigment transforms from blue to white). As the candle burns down inch by inch, the area of color change travels down along with the flame. Thus, the visual effect remains essentially constant, and can be said to work in tandem with the flame as the candle is being consumed by the flame. Upon extinction of the flame, the entire length of the candle again turns purple.

As mentioned above, the solid combustible material of the main body may be a clear self-supporting gel composition. A candle formed of such a material having a blue-to-clear thermochromic material compounded therein would initially appear to have a solid conventional candle body. After being lit, the top part of the candle may turn from blue to clear, giving the optical illusion of the top part of the candle disappearing. A candle having such a unique display would stand out in the marketplace.

The color change effect can be created by mixing into the candle main body either mixtures of conventional pigments and thermochromic or photochromic compositions, or mixtures of different thermochromic compositions, or mixtures of different photochromic compositions, or mixtures of thermochromic and photochromic compositions, or a pure single thermochromic or photochromic composition. Each of these may be incorporated into conventional wax candle materials or transparent materials. The color changing candle body is made of a composition that can be used by the amateur hobbyist, yet provides a completely unique candle display.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other color changing candles for carrying out the same purposes of the present invention. It should also be realized by those skilled in the art that such equivalent structures and the processes for forming them do not depart from the spirit and scope of the invention as set forth in the appended claims.

DETAILED DESCRIPTION OF THE INVENTION

The present invention imparts to candles the property of reversible color change. The term "candle" as used herein means any candle of any design as conventional in this art, and includes tapers (e.g., traditional dinner candles), filled or jar candles (candles formed by pouring melted wax into glass containers), votives (candles shaped to refill the glass containers after the original wax has been consumed), pillars (free-standing candles generally having a diameter of about three inches or more), etc.

The development of a color changing candle is more complex than merely mixing color changing compositions and waxes or transparent gels.

For correct burning, the radiant heat of the candle's flame must melt a small pool of the candle body material around the base of the exposed portion of the wick. The molten candle body material must have a relatively low viscosity to insure that it will be capable of being drawn up through the wick by capillary action. The candle body material can not contain any materials that would clog the wick, or combust to give off smoke or unpleasant aromas or toxic fumes.

Generally, a one-to-one ratio of pigment to conventional dyes can be used in the present invention, and optimum concentrations for burning and affordability are 0.5–1.0%. Proportions and amounts can easily be selected by those working in this art. Obviously, if the concentration were too low the effects would not be noticeable, and if the concentration of thermochromics was too high the candle would probably not burn as well. Any of the FD&C or D&C pigments can be used as the conventional color.

Other factors to be taken into consideration are discussed in U.S. Pat. No. 5,591,255 (Small, et al.) entitled "Thermochromic ink formulations, nail lacquer and methods of use". This patent concerns overcoming the problems associated with formulations that destroy the color change properties of thermochromic encapsulated dyes, and teaches that (1) certain solvents destroy the dye, therefore any aldehydes, ketones, and diols, and most aromatic compounds should be removed from the formulation and if needed they should be replaced with solvents preferably having a large molecular weight (i.e. greater than 100 and low reactivity); and (2) the formulation should be adjusted to be neutral (i.e. 6.5–7.5 pH, using HCl or KOH to adjust the pH down or up) or have a low acid value (i.e. acid number below 20 according to ASTM Test Method D-1639-70). When the thermochromic dye is added to a, formulation that has a pH outside this range, the color change properties are almost always lost. This is an irreversible effect and therefore, it is important to adjust the pH prior to adding the thermochromic dye. These two adjustments will allow the thermochromic dyes to be added to the formulation without a loss of its color change properties.

The microcapsule is hard, non-polar, thermally very stable (it won't melt), and relatively impermeable. For maximum shelf life, the infiltration of compounds such as solvent through the capsule must be stopped or slowed to the point that the characteristics of the dye are not effected. Aldehydes, ketones, diols and aromatic compounds should not be used when preparing products. The best solvents to use will be those that have low reactivity, are large molecular weight (i.e. over 100), and which are relatively non-polar. One preferred solvent is cyclohexane. It has low toxicity and works well.

Thermochromic and photochromic materials are well known, and any of these can be used in the present invention, so long as they meet the above requirements.

Reversible Photochromic Compounds

Photochromic compounds which can be used in the present invention include any reversible photochromic compounds as employed in the printing art and plastics art, including for example napthopyran compounds and other photochromic compounds as taught in U.S. Pat. Nos. 5,721,059; 5,558,700; 5,558,699; 5,514,635; 5,502,967; 5,458,815; 5,458,814; 5,466,398; 5,384,077; 5,451,344; 5,429,774; 5,411,679; 5,441,418; 5,405,958; 5,381,193; 5,369,158; 5,340,857; 5,274,132; 5,244,602; 5,223,958; 4,679,918; 4,556,605; and 4,498,919, the disclosures of these patents being incorporated herein by reference.

Specific examples of photochromic material which can be used in the present invention include organic photochromic substances such as azobenzene compounds, thioindigo compounds, dithizone metal complex compounds, spiropyran compounds, spirooxazine compounds, fulgide compounds, dihydropyrene compounds, spirothiopyran compounds, 1,4-2H-oxazine, triphenylmethane compounds, viologen compounds, naphthopyran compounds, benzopyran compounds and so on. Particularly preferred for purposes of the invention are spiropyran compounds, spirooxazine compounds, fulgide compounds, naphthopyran compounds and benzopyran compounds.

Among specific examples of said photochromic substance are 1,3,3-trimethylspiro[indoline-2,3'-(3H)naphtho(2,1-b)(1,4)-oxazine], 6'-indolino-1,3,3-trimethylspiro[indoline-2,3'-(3H)naphtho(2,1-b) (1,4)-oxazine],5-chloro-1,3,3-trimethylspiro[indoline-2,3'-(3H)naphtho(2,1-b)(1,4)-oxazine], 6'-piperidino-1,3,3-trimethylspiro[indoline-2,3'-(3H)naphtho(2,1-b)(1,4)-oxazine], 1-benzyl-3,3-dimethylspiro[indoline-2,3'-(3H)naphtho(2,1-b)(1,4)-oxazine], 1,3,5,6-tetramethyl-3-ethyl-spiro[indoline-2,3'-(3H)naphtho(2,1-b)(1,4)-oxazine], 1,3,3,5,6-pentamethylspiro[indoline-2,3'-(3H)naphtho(2,1-b)(1,4)-oxazine], 1,3,5,6-tetramethyl-3-ethylspiro[indoline-2,3'-(3H)pyrido(3,2-f)(1,4)-benzoxazine], 1,3',3'-trimethylspiro(2H-2-benzopyran-2,2'-indoline), 1,3,3-triphenylspiro[indoline-2,3'-(3H)naphtho-(2,1-b)pyran], 1-(2,3,4,5,6-pentamethylbenzyl)-3,3-dimethyl-spiro[indoline-2,3'-(3H)naphtho(2,1-b)pyran], 1-(2-nitrobenzyl)-3,3-dimethylspiro[indoline-2,3'-(3H)naphtho(2,1-b)pyran], 2,2-diphenylnaphtho(2,1-b)pyran, 2,2-di(p-methoxyphenyl)naphtho(2,1-b)pyran, 2,5-dimethylfuryltrimethylfulgide, 2-methyl-5-chlorotrimethylfulgide, spiro[2H-chromen-2,2'-tricyclo[3.3.1.1.-sup.3.7]decane, spiro[2H-naphtho[1,2-b]pyran-2,2'-tricyclo-[3.3.1.1.sup.3.7]decane], 5,7-dimethylspiro[2H-chromene-2,2'-tricyclo[3.3.1.1.sup.3.7]decane], 6-(4-methoxyphenyl)-9-methoxyspiro[2H-naphtho[1,2-b]pyran-2,2'-tricyclo][3.3.1.1.-sup.3.7]decane], 6-chlorospiro[2H-naptho[1,2-b]pyran-2,2'-tricyclo[3.3.1.1.sup.3.7]decane and so on.

The photochromic substances can be used independently but for the purpose of improving the color changing function or the fastness to light, it is preferable to concomitantly use auxiliary agents such as high-boiling solvents, plasticizers, synthetic resins, hindered amines, hindered phenols and so on. These compounds are well known additives for use in combination with photochromic substances and their proportions can be selected from the known ranges. In the present invention, for the purpose of improving the light fastness of said organic photochromic substances, the use of a hindered amine compound or a combination of a hindered amine and other auxiliary agents is recommended.

Reversible Thermochromic Materials

Most thermochromic dyes undergo a color change from a specific color to colorless (i.e. clear). Therefore, background color pigments can be provided in combination with the thermochromic compounds, such that when the thermochromic compounds change to colorless, the conventional or background pigments define the color of the candle body. If a yellow pigment is mixed into the candle body in combination with a blue thermochromic dye, the visible color will appear to change from green to yellow, when what is really happening is that the blue thermochromic dye is changing to colorless.

On the other hand, U.S. Pat. No. 5,919,404 (Fujita, et al.) entitled "Reversible thermochromic compositions" teaches a reversible thermochromic composition that has a reversible metachromatic function, that is, it presents a color-developed state when heated in a color-extinguished state and presents the color-extinguished state when temperature-dropped or cooled in the color-developed state. The composition comprises as essential components (a) an electron-donating color-developing organic compound, (b) at least one electron-accepting compound selected from alkoxyphenol compounds represented by a given formula, and and (c) a compound such as paraffin wax serving as a reaction medium capable of reversibly causing electron-donating/accepting: reaction attributable to the components (a) and (b).

It should be understood that the term "thermochromic material" is used herein to mean any and all thermochromic materials inclusive of pseudo-thermochromic materials which show a hysteresis of thermochromism.

Reversible thermochromic compositions are known which are constituted of a solubilized mixture containing essentially a reaction medium for causing reversible electron exchange between an electron-donating coloring organic compound and an electron-accepting organic compound in a specific temperature range as disclosed in U.S. Pat. Nos. 4,028,118; 4,732,810; 4,865,648; 4,720,301; 4,957,949; 4,554,565; 4,421,560; 4,425,161; and 4,421,560.

Additional examples of reversible thermochromic materials that can be used in the present invention include those disclosed in U.S. Pat. No. 5,281,570 (Hasegawa, et al.) entitled "Thermochromic materials" teaching a microencapsulated reversible thermochromic material comprising: (a) an electron donative color former; (b) a sulfide, sulfoxide or sulfone containing a hydroxy phenyl radical; and (c) a chemical compound selected from alcohols, esters, ethers, ketones, carboxylic acids or acid amides; U.S. Pat. No. 4,425,161 (Shibahashi, et al.) entitled "Thermochromic materials" teaching a thermochromic material comprising (a) an electron-donating, chromatic organic compound, (b) a compound capable of reversibly accepting an electron or electrons from the electron-donating, chromatic organic compound, (c) a compound controlling the temperature and sensitivity of coloration/decoloration of the thermochromic material and (d) a N-radical, P-radical, O-radical or S-radical cationic compound having an aromatic ring or rings which improves by light-fastness; U.S. Pat. No. 4,717,710 (Shimizu, et al.) entitled "Thermochromic composition" teaching a thermochromic composition comprising (1) an electron-donating chromogenic material, (2) a 1,2,3-triazole compound, (3) a weakly basic, sparingly soluble azomethine or carboxylic acid primary amine salt, and (4) an alcohol, amide or ester serving as a solvent; and U.S. Pat. No. 5,558,700 (Shibahashi, et al.) entitled "Reversible thermochromic composition" teaching a reversible thermochromic composition comprising a solubilized mixture of three components of (a) an electron-donating color-developing organic compound selected from pyridine types, quinazoline types, and bisquinazoline types of compound, (b) an electron-accepting compound for the electron-donating color-developing organic compound, and (c) a compound serving as a reaction medium for causing reversibly an electron exchange reaction between the components (a) and (b) within a specified temperature range, the composition developing a fluorescent color of yellow, yellowish orange, orange, reddish orange, or red with a high color density and high color brightness, yet gives no residual color under non-color-developing conditions, and has remarkably improved light resistance.

The acid-responsive chromogenic substance in said thermochromic material includes triphenylmethanephthalide compounds, phthalide compounds, phthalan compounds, acylleucomethylene blue compounds, fluoran compounds, triphenylmethane compounds, diphenylmethane compounds, spiropyran compounds and so on. Among species of such compounds are 3,6-dimethoxyfluoran, 3,6-dibutoxyfluoran, 3-diethylamino-6,8-dimethylfluoran, 3-chloro-6-phenylaminofluoran, 3-diethylamino-6-methyl-7-chlorofluoran, 3-diethylamino-7,8-benzofluoran, 2-anilino-3-methyl-6-diethylaminofluoran, 3,3',3"-tris(p-dimethylaminophenyl)phthalide, 3,3'-bis(p-dimethylaminophenyl)-phthalide, 3-diethylamino-7-phenylaminofluoran, 3,3-bis(p-diethylaminophenyl)-6-dimethylaminophthalide, 3-(4-diethyl-aminophenyl)-3-(1-ethyl-2-methylindol-3-yl)phthalide, 3-(4-diethylamino-2-methyl)phenyl-3-(1,2-dimethylindol-3-yl)phthalide, 2'-(2-chloroanilino)-6'-dibutylaminospiro-[phthalido-3,9'-xanthene] and so on.

The acidic substance mentioned above includes 1,2,3-benzotriazole compounds, phenol compounds, thiourea compounds, oxo-aromatic carboxylic acids and so on. Among specific examples of such compounds are 5-butylbenzotriazole, bisbenzotriazole-5-methane, phenol, nonylphenol, bisphenol A, bisphenol F, 2,2'-biphenol, .beta.-naphthol, 1,5-dihydroxynaphthalene, alkyl p-hydroxybenzoates, phenol resin oligomer and so on.

The amount of the acidic substance may be in the range of about 0.1 to 50 parts by weight per part by weight of the acid-responsive chromogenic substance.

Any of the thermochromic materials each containing an acid-responsive chromogenic substance and an acidic substance are preferably diluted with a solvent before use. The use of a solvent renders the material responsive to change in temperature with greater sensitivity and definition. The solvent which can be used for the thermochromic material includes, among others, alcohols, alcohol-acrylonitrile adducts, azomethine compounds, esters and so on. Among specific examples of the solvent are decyl alcohol, lauryl alcohol, myristyl alcohol, cetyl alcohol, stearyl alcohol, behenyl alcohol, lauryl alcohol-acrylonitrile adduct, myristyl alcohol-acrylonitrile adduct, stearyl alcohol-acrylonitrile adduct, benzylidene-p-toluidine, benzylidene-butylamine, octyl caprate, decyl caprate, myristyl caprylate, decyl laurate, lauryl laurate, myristyl laurate, decyl myristate, lauryl myristate, cetyl myristate, lauryl palmitate, cetyl palmitate, stearyl palmitate, cetyl p-t-butylbenzoate, stearyl 4-methoxybenzoate, dilauryl thiodipropionate, dimyristyl thiodipropionate, stearyl benzoate, benzyl stearate, dibenzyl thiodipropionate, distearyl thiodipropionate, benzyl benzoate, glycerol trilaurate and so on.

The amount of the solvent may be in the range of 0 to 800 parts by weight, preferably 0.1 to 100 parts by weight, per part by weight of the acid-responsive chromogenic substance.

Microencapsulation of Thermo- and/or Photochromic Materials

In the present invention, the reversibly variable color material can be directly blended with wax or can be microencapsulated beforehand. The microencapsulation can be carried out using the reversibly variable color material, a shell-forming polymer and, where necessary, a surfactant, protective colloid, pH control agent, electrolyte, etc., the desired microcapsules can be prepared in water by any of interfacial polymerization, in situ polymerization, coacervation, air suspension, interfacial precipitation and other techniques. By such processes, microcapsules including the reversibly variable color material and measuring about 1 to 50 $\mu$m in diameter can be obtained. It is also possible to provide double-or multiple-walled microcapsules by using one, two or more of the microencapsulation techniques mentioned above. The preferred shell-forming material includes a polyamine and a carbonyl compound for forming a polyurea shell, a polybasic acid chloride and a polyamine for forming a polyamide shell, a polyisocyanate and a polyhydroxy compound for forming a polyurethane shell, a polybasic acid chloride and a polyhydroxy compound for forming a polyester shell, an epoxy compound and a polyamine for forming an epoxy resin shell, a melamine-formaldehyde prepolymer for forming a melamine resin shell and a urea-formaldehyde prepolymer for forming a urea resin shell, as well as ethylcellulose, polystyrene, polyvinyl acetate and so on. The shell of said microcapsules is preferably made of a thermosetting material which is superior in heat resistance.

Waxes

When using a wax to form the matrix of as in a conventional wax candle main body, the wax is preferably mainly constituted of at least one type of wax selected from a group of waxes that includes animal waxes (e.g., whale oil wax, beef tallow hardened oil, fish oil hardened oil), bees waxes (e.g., as obtained from honey bees), plant waxes (e.g., repeseed hardened oil, montan wax, palm wax, sugar cane wax, carnauba wax, candelilla wax, calnoba wax, vegetable tallow, oliquy wax, Douglas Fir bark wax, rice bran wax, jojoba wax and bayberry wax), mineral waxes (e.g., ceresin wax, montan wax, peet wax and ozokerite wax) and petroleum wax (e.g., paraffin wax having a melting point of from 50 to 120° C., microcrystalline wax, petrolatum, paraffin oxide wax and petrolatum oxide, microcrystalline wax and crystalline wax) and synthetic waxes (e.g., ethylene-vinyl acetate copolymer wax, ethylene-acrylate copolymer wax and vinyl ether wax polyethylene wax, Fischer-Tropsch wax, chemical modification hydrocarbon wax and substitution amido wax).

Any wax supplier can provide a wax suitable for use in a candle, and suppliers include Ross, Walnut Hill, More & Munger, and American Candle Corp.

Clear Gel Compositions

Self supporting clear gel formulations useful for forming the candle main body are disclosed in U.S. Pat. Nos. 5,882,363 (Spaulding, et al.) entitled "Clear compositions for use in solid transparent candles" and 5,843,194 (Spaulding) entitled "Clear gel formulation for use in transparent candles". These patents teach clear solid compositions that may be used as the base material of a transparent candle. In one form, the compositions comprise one or more polyamide resins, which may be present in a total amount of about 40–70% by weight of the composition; and one or more 12-hydroxystearic acid ester solvents, which may be present in a total amount of about 10–70% by weight of the composition. The compositions have a high degree of clarity, with little or no haze or cloudiness, even when fragrances or coloring agents have been added. The compositions can be formulated not darken or smoke when a candle made of the composition is burning, and so that candles made of the composition do not crack or split during burning, nor suffer from syneresis. Moreover, the transparent candles formed of the clear solid composition are self-supporting, and do not require a container or external support, unlike clear gel candles. The transparent candles also have other desirable aesthetic features, such as a waxy feel.

The composition includes a gellant and a solvent, mixed together. The gellant provides structure to the candle. The solvent binds to the gellant, and has a large effect on the burning characteristics of the candles, such as whether the candle smokes while burning, whether the pool darkens during burning, and the heat of the flame.

A preferred liquid base material of the present invention, hydrogenated polyisobutene, has the advantage of being readily available in commercial quantities as an ingredient that is listed in the Cosmetic Toiletry and Fragrance Associate Ingredient Dictionary, having a CAS number of 68937-10-0. The odorless, low volatility base materials of the present invention are, thus, recognized as toxicologically safe for use in the cosmetic arts. Furthermore, the base materials of the present invention have no tendency to auto-ignite. Such auto-ignition, which is caused by excessive fumes emanating from the surface, may occur with certain prior art transparent candle compositions, such as those which use kerosene, lamp oil or a mineral oil/styrene/rubber copolymer mix.

Isostearyl alcohol or dimethyl isosorbide could be added as a flame-enhancing agent, so as to produce whiter, hotter flames, they also provide improved gel clarity by reducing the haze that may sometimes be produced in the gel.

Two classes of polyamides are typically soluble in solvents of interest, and are preferred gellants for the present invention: (1) polyamides based on terpolymers of simple nylons (such as DuPont ELVAMIDE™ 8061, which is a terpolymer of nylon 6, nylon 66, and nylon 610); and (2) polyamides based on complex fatty acids, such as the VERSAMID™ series of Henkel Corp. or the UNIREZ™ series of Union Camp Corp. U.S. Pat. No. 5,500,209 provides a more detailed description of these polyamides. The preferred gellant is the polyamide resin VERSAMID™ 1655, available from the Henkel Corporation located in Ambler, Pa.

Go Suitable solvents include esters of 12-hydroxystearic acid with a monohydric or polyhydric alcohol, i.e., octylhydroxystearate and derivatives thereof. This class of solvents is referred to herein as "12-hydroxystearic acid esters." More preferably, the solvent is octylhydroxystearate, available commercially as WICKENOL™ 171 from Alzo, Inc., located in Matawan, N.J., or as CRODAMOL™ OHS from Croda, Inc., located in Parsippany, N.J.

Clear candles made from a composition using VERSAMID™ 1655 as the gellant and octylhydroxystearate as the solvent are hard to the touch and capable of self-support, and do not require a container. Also, such a candle does not significantly darken or smoke during burning.

Other transparent candle compositions include a thermoplastic polyamide resin and a flammable solvent for solubilizing the resin, such as described in U.S. Pat. Nos. 3,615,289 and 3,819,342; however, these are vulnerable to auto-ignition, and tend to sweat, produce black smoke, and darken during burning. Sweating is not only an aesthetic drawback, but can be a performance or safety problem as well. If a candle sweats, the oil on the surface is available to ignite, which can result in an uncontrolled or torch-like situation rather than a candle.

U.S. Pat. No. 5,578,089 describes a heterophase thermally reversible mineral oil gel formed by a system of physically crosslinked block copolymers which purportedly overcome the problem of sweating and syneresis by adjusting the ratio of diblock and triblock polymers so as to ensure that all the oil remains entrained: within a system of physically crosslinked copolymers. The thermoplastic rubber type polymers of U.S. Pat. No. 5,578,029 consist of block segments of styrene monomer units and rubber monomer units, wherein each block segment may consist of 100 monomer units or more. While such compositions are alleged to provide an improvement over the prior art transparent candle compositions, styrene/rubber-based candle compositions are susceptible to surface ignition, which may produce black smoke, and also have limited fragrance throw.

U.S. Pat. No. 5,578,089 (Elsamaloty) entitled "Clear candle" teaches a clear candle made from a gel comprising mineral oil containing blends of diblock and triblock copolymers based on synthetic thermal plastic rubbers. The clear candle is stable, does not separate, and does not flash when burned. The candle, although free standing at room temperature, is preferably supplied in a container, and it may be colored and/or scented.

The invention will now be described in greater detail by way of the following examples.

The present invention contemplates the use of a clear gel prepared from a liquid base material comprised of hydrogenated polyisobutene and N-acyl glutamic acid diamide, the hydrogenated polyisobutene being comprised of a higher viscosity component having an average number of repeating units of about 23 and a lower viscosity component having an average number of repeating units of about 6 to 8.

Comparative Example 1

A photochromic candle was made using off-the-shelf ingredients as follows:

| | |
|---|---|
| Wax relevant to final application | q.s. |
| Colortell ™ Thermochromic Paraffin Wax 61.5C Type 27PW Vermillion | 0–3.0% |
| FD&C Yellow #5 @ 0.1% in Benzyl Benzoate | 0–3.0% |
| Dragoco Fragrance | 0–10.0% |

Colortell is a trademark of Clark R&D, Rolling Meadows, Ill. Clark R&D uses pigments supplied by Matsui, and then creates the different forms of inks, i.e., paraffin wax based inks, water dispersion inks, mineral oil dispersion inks, etc. These inks are printed onto plastic cups, baby bottles, beverage containers, thermometers, or spoons and change color to say "hot" or "cold". However, these inks had not previously been used in candles.

The wax was melted completely. The thermochromic pigment was then added, and the heat was increased until the pigment was thoroughly dispersed (generally 20–30° C. above the wax MP). The product became opaque white. Next, conventional dye FD&C Yellow #5 was mixed in and the composition was allowed to begin cooling. The product was pale yellow. As the product was cooling, the fragrance was added at about 10 degrees above the pour point. The mixture was poured into an appropriate wicked container and allowed to cool and solidify.

The candle solidified in an orange color. When the candle was burned it changed to yellow revealing the conventional dye color, and returned to orange when cooled. However, the product smoked and gave off an unpleasant odor. It was determined that thermochromic pigments used in the initial experiments were Matsui products "Chromicolor PE" Concentrates: Brown, Yellow, Pink, Blue & Black. These are polyethylene based, were hard to incorporate, and would smoke at high concentrations.

EXAMPLE 1

The procedure of Comparative Example 1 was repeated using the same materials, except that thermochromic pigments were compounded directly into wax without polyethylene.

It was found that higher concentrations of thermochromic pigment could be directly incorporated into the wax, and that the candle did not smoke or give off an unpleasant odor.

EXAMPLE 2

The procedure of Example 1 was repeated, with the formulation changed to the following:

| | |
|---|---|
| Wax relevant to final application | q.s. |
| Colortell Thermochromic Paraffin Wax 61.5C Type 27PW Fast Black | 0–3.0% |
| FD&C Red #33 @ 0.1% in Benzyl Benzoate | 0–3.0% |
| Dragoco Fragrance | 0–10.0% |

As in Example 1, the thennochromic pigment compounded into the wax was free of polyethylene. This candle burned well, turned from black to pink when burned and then reversed back to black after extinction of the flame.

EXAMPLE 3

The procedure of Example 1 was repeated, with the formulation changed to the following:

| | |
|---|---|
| Wax relevant to final application | q.s. |
| Colortell Thermochromic Paraffin Wax 61.5C Type 27PW Turquoise Blue | 0–3.0% |
| FD&C Red #33 @ 0.1% in Benzyl Benzoate | 0–3.0% |
| Dragoco Fragrance | 0–10.0% |

This candle had the same burn characteristics as the candle of Example 1, and changed in color from purple to pink when burned.

EXAMPLE 4

The procedure of Example 1 was repeated twice more, with the formulation changed to use the following paraffin waxes, respectively:

Colortell Thermochromic Paraffin Wax 61.5C Type 27PW Pink

Colortell Thermochromic Paraffin Wax 61.5C Type 27PW Yellow These candles exhibited good burn and color change characteristics.

EXAMPLE 5

Solvent is added to a suitably sized container, which is agitated and heated to a temperature of 80° C. A gellant is added, a little at a time, while the contents of the container are heated to 94–96° C. and agitated. No other components are added until a phase change is observed, indicating that the gellant had bound completely with the hydroxy group on the solvent. Then the other components are added, one at a time, stirring between each component. Last to be added is a microencapsulated thermochromic material (trademark: Chromicolor Fast Blue S-27, Matsui Sikiso Chemical Co. Ltd.; a blue acid-responsive chromogenic substance, a phenolic acidic substance and an alcoholic solvent all microencapsulated in thermosetting resin). The composition is poured into a mold, and a wick is added while the composition is liquid. The composition is allowed to cool to room temperature and solidify to form a candle which is blue at 25° C. The candle becomes colorless in the area warmed by the flame above 35° C.

EXAMPLE 6

A microencapsulated photochromic material (trademark: Photopia Yellow, Matsui Shikiso Chemical Co., Ltd.; a naphthopyran photochromic compound, a synthetic resin and a plasticizer all microencapsulated in a thermosetting resin) is blended with a clear gel as in Example 5 and a candle is formed. This candle is colorless in a room not exposed to direct sunlight but turns deep yellow in the area of the flame when the candle is lit.

EXAMPLE 7

A microencapsulated photochromic material [1 part by weight of 1,3,3-trimethylspiro[indoline-2,3'-(3H)naphtho(2,1-b)(1,4)-oxazine] (an organic photochromic compound) and a bis(1,2,2,6,6-pentamethyl-4-piperidinyl)sebacate (a hindered amine compound) is microencapsulated in 5 parts by weight of epoxy resin. The microcapsules are compounded into a clear gel as in Example 5. The composition is white in a room not exposed to direct sunlight, it turns deep blue in the area near the flame when the candle is lit.

EXAMPLE 8

A microencapsulated thermochromic material (trademark: Chromicolor Green S-35, Matsui Shikiso Chemical Co., Ltd.; a green acid-responsive chromogenic substance, a phenolic acidic substance and an alcoholic solvent as microencapsulated in thermosetting resin) is mixed into clear gel which is used to form the main body of a candle. While the candle is green at room temperature (25° C.), it becomes colorless when warmed to 35° C.

EXAMPLE 9

A microencapsulated thermochromic material (trademark: Chromicolor Yellow S-15, Matsui Shikiso Chemical Co., Ltd.; a yellow acid-responsive chromogenic substance, a phenolic acidic substance and an alcoholic solvent all microencapsulated in thermosetting resin) and magnesium stearate are mixed with a paraffin wax to form a yellow candle. The candle is lit, and the yellow part of the candle becomes colorless when the temperature reaches 35° C., and becomes yellow again at 25° C. These changes could recur a number of times.

Although this invention has been described in its preferred form with a certain degree of particularity with respect to color changing wax and gel solid candles, it is understood that the present disclosure of the preferred form has been made only by way of example and that numerous changes in the details of structures and the composition of the combination may be resorted to without departing from the spirit and scope of the invention.

What is claimed is:

1. A candle comprising:

a) a solid combustible matrix selected from the group consisting of animal waxes, bees waxes, plant waxes and mineral waxes, b) at least one color-fast coloring agent, c) at least one micro-encapsulated reversible thermochromic material, and d) a wick wherein after the candle is lit, the solid combustible matrix includes a melted portion and a solid portion, wherein said coloring agent (s) and said at least one micro-encapsulated reversible thermochromic material are blended into said solid combustible matrix, and wherein said at least one reversible material produces a visible color change in the solid portion of the combustible matrix exposed to heat produced by the candle flame; and wherein components (a)–(d) form a homogeneous mixture.

2. A candle comprising:

a) a solid combustible matrix, b) at least one color-fast coloring agent, c) at least one micro-encapsulated reversible thermochromic material, and d) a wick wherein after the candle is lit, the solid combustible matrix includes a solid portion and a melted portion wherein said coloring agent (s) and said at least one micr-oencapsulated reversible thermochromic material are blended into said solid combustible matrix, and wherein said at least one reversible material produce a visible color change in the solid portion of the combustible matrix exposed to heat produced by the candle flame; and wherein said solid combustible matrix is a clear gel.

3. A candle as in claim 2, wherein said clear gel is comprised of one or more polyamide resins, which may be present in a total amount of about 40–70% by weight of the matrix, and one or more 12-hydroxystearic acid ester solvents, which may be present in a total amount of about 10–70% by weight of the matrix.

4. A candle as in claim 2, wherein said clear gel is prepared from a liquid base material comprised of hydrogenated polyisobutene and N-acyl glutamic acrid diamide, the hydrogenated polyisobutene being comprised of a higher viscosity component having an average number of repeating units of about 23 and a lower viscosity component having an average number of repeating units of about 6 to 8.

5. A candle as in claim 2, wherein said thermochromic material is a solubilized mixture consisting essentially of a reaction medium, an electron-donating coloring organic compound and an electron-accepting organic compound.

6. A candle comprising:

(a) a solid combustible matrix, (b) at least one color-fast coloring agent, (c) at least two thermochromic materials of different color, and d) a wick wherein after the candle is lit, the combustible matrix includes a melted portion and a solid portion, wherein said at least one color-fast coloring agents and said at least two thermochromic materials of different color are blended into said solid combustible matrix, and wherein said thermochromic materials are each present in an amount sufficient to produce a visible color change in the solid portion of the combustible matrix selected from the group consisting of animal waxes, bees waxes, plant waxes and mineral waxes exposed to heat produced by the candle flame.

7. A candle comprising:

(a) a solid combustible matrix, (b) at least one color-fast coloring agent, (c) at least two thermochromic material of different color, and (d) a wick wherein said at least one color-fast coloring agent and said at least two thermochromic material of different color are blended into said solid combustible matrix, and wherein said thermochromic, materials are each present in an amount sufficient to produce in the solid combustible matrix a visible color change in the portion of said candle exposed to heat produced by the candle flame, and wherein said solid combustible matrix is a clear gel.

8. If A candle as in claim 7, wherein said clear gel is comprised of one or more polyamide resins, which may be present in a total amount of about 40–70 by weight of the matrix, and one or more 12-hydroxystearic acid ester solvents, which may be present in a total amount of about 10–70% by weight of the matrix.

9. A candle as in claim 7, wherein said clear gel is prepared from a liquid base material comprised of hydrogenated polyisobutene and N-acyl glutamic acid diamide, the hydrogenated polyisobutene being comprised of a higher viscosity component having an average number of repeating units of about 23 and a lower viscosity component having an average number of repeating units of about 6 to 8.

* * * * *